US007070723B2

(12) United States Patent
Ruitenberg et al.

(10) Patent No.: US 7,070,723 B2
(45) Date of Patent: Jul. 4, 2006

(54) METHOD FOR SPIN-DRAWING OF MELT-SPUN YARNS

(75) Inventors: Gerrit Ruitenberg, Velp (NL); Bastiaan Krins, Dieren (NL)

(73) Assignee: Diolen Industrial Fibers BV, Arnhem (NL)

( * ) Notice: Subject to any disclaimer, the term of this patent is extended or adjusted under 35 U.S.C. 154(b) by 243 days.

(21) Appl. No.: 10/250,505

(22) PCT Filed: Dec. 22, 2001

(86) PCT No.: PCT/EP01/15301

§ 371 (c)(1),
(2), (4) Date: Jul. 3, 2003

(87) PCT Pub. No.: WO02/053814

PCT Pub. Date: Jul. 11, 2002

(65) Prior Publication Data

US 2004/0032049 A1 Feb. 19, 2004

(30) Foreign Application Priority Data

Jan. 5, 2001 (EP) ..... 01100404

(51) Int. Cl.
*D01D 5/088* (2006.01)
*D01D 5/092* (2006.01)
*D01D 5/16* (2006.01)

(52) U.S. Cl. ..... 264/103; 264/130; 264/178 F; 264/210.7; 264/210.8; 264/211.14; 264/211.15; 264/342 RE

(58) Field of Classification Search ..... 264/178 F, 264/210.8, 289.6, 103, 211.14, 130, 210.7, 264/211.15, 342 RE
See application file for complete search history.

(56) References Cited

U.S. PATENT DOCUMENTS 2,934,400 A * 4/1960 Siggel et al. ..... 264/210.8
3,002,804 A * 10/1961 Kilian ..... 264/181
5,279,783 A * 1/1994 Liu et al. ..... 264/178 F
5,612,063 A * 3/1997 Schilo et al. ..... 425/72.2
5,785,997 A * 7/1998 Budenbender et al. ..... 425/71
6,103,158 A * 8/2000 Schafer et al. ..... 264/103

* cited by examiner

*Primary Examiner*—Leo B. Tentoni
(74) *Attorney, Agent, or Firm*—Oliff & Berridge, PLC

(57) ABSTRACT

A method is provided for simultaneous spin-drawing of continuous yarns consisting of one or more filaments, comprising the steps in which a melt of a thermoplastic material is fed to a spinning device, the melt is extruded through a spinneret by means of extrusion openings with the formation of continuous yarns, the continuous yarns are cooled by feeding them through a first and a second cooling zone, wherein the continuous yarns are cooled essentially by a stream of air on passing through the first cooling zone and essentially by a fluid, consisting wholly or partly of a component that is liquid at room temperature, on passing through the second cooling zone, and the continuous yarns are then dried, subsequently drawn and wound up by means of winding devices, the method being distinguished in that the continuous yarns are fed through the first and second cooling zones at a speed of up to 500 m/min and that the residence time of the continuous yarns within the first cooling zone is at least 0.1 sec.

18 Claims, 1 Drawing Sheet

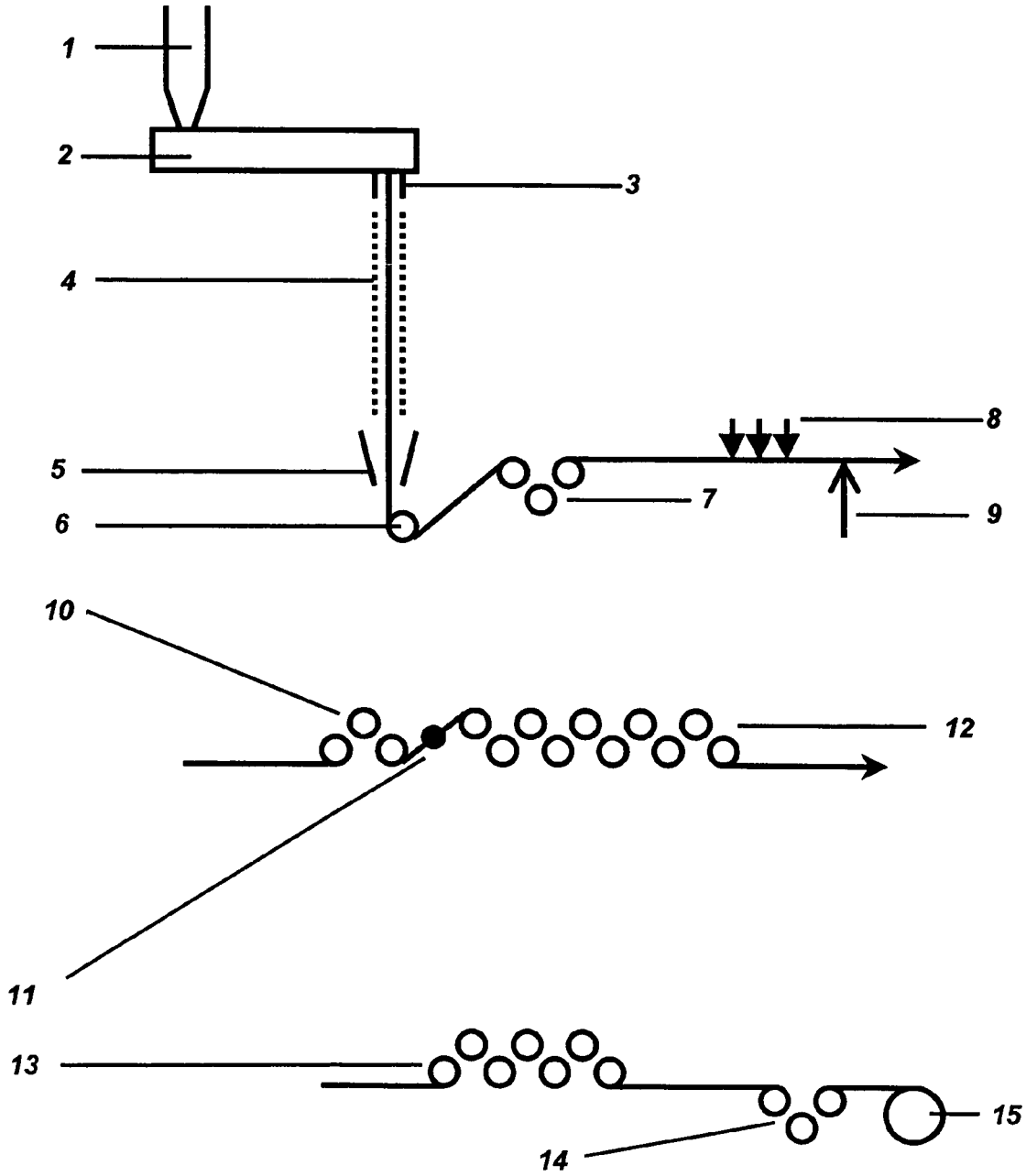
1
2
3
4
5
6
7
8
9
10
11
12
13
14
15

METHOD FOR SPIN-DRAWING OF MELT-SPUN YARNS

The present invention relates to a method for simultaneous spin-drawing of continuous yarns consisting of one or more filaments, comprising the steps in which a melt of a thermoplastic material is fed to a spinning device, the melt is extruded through a spinneret by means of extrusion openings with the formation of continuous yarns, the continuous yarns are cooled by feeding them through a first and a second cooling zone, wherein the continuous yarns are cooled essentially by a stream of air on passing through the first cooling zone and essentially by a fluid, consisting wholly or partly of a component that is liquid at room temperature, on passing through the second cooling zone, and the continuous yarns are then dried, subsequently drawn and wound up by means of winding devices.

A method of this type is known from EP 0 937 791. This patent specification discloses a method for spinning a continuous yarn of a thermoplastic material, in which the thermoplastic material is pressed through a spinneret to form a filament bundle comprising a plurality of filaments, in which the filament bundle is cooled prior to being collected into thread, and in which cooling occurs essentially in two cooling zones. In a first cooling zone the filaments are cooled directly under the spinneret by a stream of air perpendicular to the direction of the thread, and in a second cooling zone by a stream of moist air, the cooling stream in the second cooling zone being produced independently of the airstream in the first cooling zone, and the cooling stream for cooling the filament bundle within the second cooling zone flowing in the direction opposite to that of the movement of the thread. According to EP 0 937 791, the first cooling zone has a length of 0.1 to 1 m. After the thread has been drawn off from the spinneret, treatment can be supplemented or substituted by drawing, heating, relaxing or intermingling. However it is also possible, according to what is disclosed in this patent specification, to operate the spinning process without rolls, the thread being drawn off directly from the spinneret by means of a winding-up device. Winding speeds of up to 5000 m/min are attained in this way by the method described in EP 0 937 791.

In practice, however, problems frequently arise in the use of the prior art method described for production of high-strength yarns, particularly high-strength industrial yarns of high modulus or low shrinkage, with the result that the required strengths and/or modulus values are not attained. This is most particularly the case if high output is important, i.e., the method is carried out at high speeds and correspondingly high throughput rates, when an undesirable increase in thread breakage could occur. These problems are even more pronounced when polymers such as polyamide or polyester are used as the thermoplastic materials for carrying out the process.

The object of the present invention is to at least reduce the disadvantages of the prior art described above.

It has now surprisingly been found that the object of the invention is achieved if the method described initially for simultaneous spin-drawing of continuous yarns is carried out such that the continuous yarns are passed through the first and second cooling zones at a speed of up to 500 m/min and the residence time of the continuous yarns within the first cooling zone is at least 0.1 sec. The residence time within the first cooling zone is preferably no longer than 0.3 sec.

It is most especially preferred, in the method of the invention, if the residence time of the continuous yarns within the first cooling zone lies between 0.1 and 0.25 sec.

The speed at which the continuous yarns are fed through the first and second cooling zones is preferably at least 100 m/min. As a general rule, yarn speeds of approx. 150 to approx. 400 m/min, e.g. 300 m/min, are entirely adequate to obtain uniform yarns of high strength and/or modulus values. The speed is generally measured after the yarn has left the second cooling zone, which is preferred, or after the first cooling zone.

Throughout this description, the term "continuous yarns", also referred to below simply as "yarns", refers to linear structures consisting of one or more filaments. The method can therefore also be carried out with multifilament as well as monofilament yarns, i.e., continuous yarns consisting of only a single filament. There is in principle no restriction on the number of individual threads or filaments comprising a multifilament yarn. A multifilament generally comprises between 10 and 500 filaments, and frequently between 50 and 300 filaments. The multifilaments are usually collected in the course of the process into so-called filament bundles and are wound up in this form. The titre of the filaments comprising the continuous yarns, i.e. the filament titre, can also vary within wide limits. In general, however, filament titres in the range of approx. 1 to approx. 30 dtex, and preferably between 5 and 20 dtex, are used.

As mentioned above, the method of the invention is found to be particularly advantageous if the thermoplastic material used in the process consists essentially of polyester or polyamide. The terms polyester and polyamide are to be interpreted here in a broad sense and include also copolyesters and copolyamides and mixtures thereof. Polyethylene terephthalate, nylon-6, nylon-6,6 and nylon-4,6 are most particularly preferred.

The speed at which the yarns are fed through the cooling zones, which is low in relation to the prior art, makes possible the relatively long residence time in the first cooling zone in the method of the invention and leads, particularly when the last-mentioned polymers are used as the thermoplastic material, to continuous yarns distinguished by high strength, high modulus and good yarn uniformity. These properties make the yarns obtained by the method of the invention very highly suitable for industrial applications.

The first cooling zone is situated almost directly under the spinneret. A heated tube (hot tube) may be placed between the spinneret and the first cooling zone. In its simplest embodiment, the first cooling zone can be simply an air gap located between the spinneret or hot tube and the second cooling zone. Cooling then occurs simply on traversing the ambient air, by self-aspiration and/or by blowing with a gaseous medium such as air or nitrogen. Preferably, however, the continuous yarns are fed essentially through an air-permeable porous tube as the first cooling zone. This tube provides better stabilisation of the passage of the continuous yarns, which could otherwise be blown away by the movement of air in the spinning environment or by the blowing of gases. If the air-permeable porous tube and hot tube are both present, they can be separated if necessary by a narrow gap about 10 mm in width for better aspiration.

In the method of the invention, the length of this first cooling zone is determined by the speed of the yarns to be fed through it and by their residence time. Thus, for example, for a feed rate of 300 m/min and a residence time of approx. 0.15 sec the first cooling zone has a length of approx. 75 cm. This relatively long length of the first cooling zone combined with a low feed rate is contrary to the teaching of EP 0 937 791, which neither discloses nor teaches that the yarn properties are improved by high residence times in the first cooling zone. It is assumed that during the residence time of the continuous yarns in the first cooling zone good stabilisation is induced, which is advantageous to the behaviour in the subsequent stages of the procedure and to the properties of the yarn.

In general, the temperature of the continuous yarns after leaving the first cooling zone is between 100° C. and 150° C.

Further cooling by means of a fluid occurs in the second cooling zone, where the yarns are brought to a temperature that is required or desirable for the subsequent steps in the method of the invention. If the first cooling zone consists of an air-permeable porous tube or similar device, a gap of 10 to 500 mm, preferably 10 to 200 mm, can exist between the first and second cooling zones. The fluid used for cooling in the second cooling zone consists wholly or partly of a component that is liquid at room temperature such as water, water vapour, alcohol or mixtures of these components with gaseous media, e.g. air or nitrogen. The second cooling zone can be implemented in various embodiments in the method of the invention. In a preferred embodiment, the continuous yarns are cooled while being fed through the second cooling zone essentially by a fluid consisting partly or entirely of water.

In a simple and advantageous embodiment of the method of the invention, the continuous yarns are cooled essentially by a water-bath while being fed through the second cooling zone. Care must be taken here that the water temperature is not too high, to avoid adhesion between the filaments. It has been shown to be advantageous if the temperature of the water-bath is at least 10° C. below the glass transition temperature (Tg) of the thermoplastic material used. In the case of polyethylene terephthalate (Tg approx. 80° C.) a bath temperature of approx. 60° C. has proved to be suitable.

The most preferred embodiment, however, is one in which the continuous yarns are cooled, on passing through the second cooling zone, essentially by a spray mist of small water droplets. This embodiment exploits the fact that small water droplets, preferably with average diameter not exceeding 150 μm, can dissipate a significantly greater amount of heat than is possible by passage through a water-bath. The reason for this is the additional heat of vaporisation of the droplets, the necessary heat energy being extracted from the yarns. The droplets are advantageously brought into contact with the continuous yarns with the help of air blown from nozzles. In this case the second cooling zone can take the form of, for example, a mist chamber with nozzles attached at its lower end, which direct the spray mist onto the yarns in the direction opposite to that of the yarn movement and at an angle of, e.g., 45°. The air here serves primarily as a transport medium to bring the water droplets into contact with the yarn. The above-mentioned gap between the air-permeable porous tube and the second cooling zone serves for the exit of hot air from the first cooling zone and, if required, also as an outlet for the heated spray mist. Measurement of average droplet size is known per se, and is performed in the present invention by the method of ASTM E 799.

The residence time of the continuous yarns in the second cooling zone is always lower than in the first cooling zone, which is reflected in a significantly shorter length of the second cooling zone as compared with the first. "Significantly shorter" means in practice that the length of the second cooling zone is approx. 50% of that of the first. In general this length is approx. 50 cm. Using this information, those skilled in the art can easily determine the most favourable length for the second cooling zone by means of a few simple experiments.

The drawing off of the continuous yarns from the cooling zones is effected by rolls, advantageously by a trio of rolls. This drawing off occurs via a guide roll, which, if a water-bath is used as the second cooling zone, is advantageously located within this bath, and if a mist chamber is used, is placed directly after this chamber. The distance between the spinneret and the guide roll is generally not critical. However it has been found to be advantageous if the guide roll is located approx. 2.5 m, and preferably approx. 2.0 m, below the spinneret. The process of the invention can then be continued at a single level. This has the advantage that the entire apparatus for carrying out the process has and requires only a small overall height ("one-floor machine").

The continuous yarns cooled as described above are then dried, in preparation for the drawing process, by a method known per se, e.g., by the application of air, for example compressed air at ambient temperature, by means of a blower.

After drying, the continuous yarns can be treated with conventional spinning oils, preferably with one of the so-called neat oils. Spinning oils of this type are known to those skilled in the art and facilitate performance of the subsequent steps of the process.

As has been stated above, drying or treatment with spinning oil is followed, in the method of the invention, by drawing, in the course of which the yarns are brought to the required draw ratio by means of rolls using a method that is known per se. In a preferred embodiment of the invention, the continuous yarns are drawn by means of a sequence of 13 rolls, a tridectet. The temperature of these rolls is advantageously chosen such that their temperature increases stepwise in the course of drawing from approx. 80° C. to approx. 240° C., preferably from approx. 120° C. to approx. 240° C.

It is preferable, however, that the continuous yarns be subjected also to a pre-drawing process. In the context of the method of the present invention, pre-drawing is understood to be an additional drawing of the continuous yarns carried out prior to the above-mentioned drawing. Pre-drawing of this type can result in a draw ratio close to the final value to be set in the process.

Drawing and pre-drawing are both preferably carried out using rolls. In a highly advantageous embodiment of the invention, these rolls are arranged in the form of a tridectet, i.e., the continuous yarns are drawn by a total of 13 heated rolls in two stages. In the first stage, the pre-drawing, a draw ratio of approx. 2 to approx. 5 is attained. The pre-drawn continuous yarns are then once again drawn in a second stage, the drawing stage, with a draw ratio between 1.1 and 3.0, preferably between 1.2 and 1.8.

If the pre-drawing described above is integrated into the tridectet of rolls used for drawing, it is extremely advantageous if the pre-drawing is performed using a steam-emitting nozzle. A nozzle of this kind is known per se and could be positioned, for example, after the first trio of rolls of the above-mentioned tridectet. In this last case, the rolls of the tridectet could be so operated, for example, that the first three rolls are used to set the yarn temperature of approx. 70° C. that is favourable for pre-drawing; these are followed by the steam nozzle, which in turn is followed by a further three rolls that bring the yarn to the temperature favourable for drawing, e.g. 120° C., and finally by seven rolls to arrive at the final drawing temperature of, e.g., 240° C. Pre-drawing is therefore carried out here with the help of a steam nozzle between the third and fourth rolls of the tridectet.

For certain applications it can also be advantageous if pre-drawing is carried out directly after the yarn has left the second cooling zone and before drying. In an embodiment of this type it is preferred that pre-drawing be carried out in a water-bath placed after the draw-off rolls that draw the continuous yarns out of the cooling zones. The continuous yarns are fed from the above-mentioned draw-off rolls through a water-bath at a temperature of approx. 90° C. and over a pin in the water-bath, and are then drawn by means of a roll downstream of the water-bath. By this means, the draw ratios of between approx. 2 and approx. 5 that are favourable for pre-drawing can advantageously be set at this early stage in the process. The particular advantages of carrying out pre-drawing in this way are that the drawing temperature can be easily regulated via the water temperature and that the heat generated by the drawing process can be efficiently dissipated. Drying of the continuous yarns and, if required, treatment with spin finish are then carried out as described above.

If pre-drawing is carried out by means of a water-bath, it may be sufficient to use only nine rolls for the drawing stage.

The residence time of the continuous yarns at the final temperature for drawing can optionally be achieved by conducting the yarns through a heater, in which they are maintained, without contact, at the required temperature. This measure can improve the structural properties of the yarns obtained.

Drawing is usually followed by a relaxation step in which the yarns are relaxed, again by means of heated rolls. For this purpose the continuous yarns are advantageously guided over a septet of rolls which are at a temperature between approx. 180° C. and 240° C., e.g. at 220° C. The relaxation ratio generally lies between approx. 0.8 and 1. This relaxation step can optionally be followed by setting in a heater in which the continuous yarns are maintained without contact at the final temperature of the relaxation stage. It is advantageous to interpose a further trio of rolls following the septet or the optional heater, and immediately before winding up. This trio of rolls can introduce an additional relaxation step into the method of the invention. This additional relaxation step can bring advantages in many cases, particularly in regard to attainment of low shrinkage properties. It is even possible in principle, and in many cases desirable, that the relaxation step is performed using only the trio of rolls and that this is then the only relaxation in the process. In such cases, it is possible to dispense with relaxation by the septet, or even with the septet altogether; relaxation is then carried out solely with the trio of rolls at a draw ratio of approx. 0.75 to approx. 1.

The continuous yarns produced by the method of the present invention are advantageously wound up at speeds under 3000 m/min, e.g., between 1500 and 2500 m/min.

As a result of the special concept of the process of the invention, these speeds, which are relatively low as compared with those used in the prior art, are nevertheless sufficient for economical production of yarns with high strength and high modulus. One particular advantage lies in the low height of the apparatus required to carry out the process, which is a so-called "one-floor machine".

A further advantage lies in the fact that the process described can be used for simple production of more than six continuous yarns simultaneously. The number of continuous yarns that can be simultaneously produced is restricted in principle only by the rolls used in the process. The important parameters determining this use, such as the length of the rolls and force absorption, particularly in the transverse direction, are known to those skilled in the art. In general it is possible to produce by the method of the invention 8, 16, 24, 32 or even 96 continuous yarns simultaneously. This economic advantage, arising partly on account of the special cooling conditions in the process of the invention, more than compensates for any loss of capacity that might result from the lower speeds as compared with those used in the prior art.

The method of the invention is now described in detail with the help of a diagram showing an apparatus suitable for carrying out the method, and an example of an embodiment. In the figure, which is schematic only, the device suitable for carrying out the method is shown in three sections; an arrow on the right pointing towards the margin indicates that the section of the diagram below connects to the section ending with the arrow.

In the process flow represented in the diagram, polyethylene terephthalate (PET) with a relative solution viscosity of 2.05 (measured in a concentration of 0.5% by weight in m-cresol at 25° C.) is metered from the reservoir 1 into the extruder 2. The diameter of the extruder 2 is 60 mm. The PET is melted at approx. 300° C. and then extruded through a spinneret with 211 holes. The continuous yarns are guided through a hot tube 3 of length 12 cm at 300° C. The continuous yarns are then fed through a perforated tube 4, of length 1 m, as the first cooling zone. Between the hot tube 3 and the perforated tube 4 is a slit of length 10 mm. The residence time in the first cooling zone is 0.2 sec. The continuous yarns are then fed into a mist chamber 5 as the second cooling zone. This second cooling zone is of length 50 cm, and within this mist chamber the continuous yarns are cooled by means of a spray mist produced by nozzles at a pressure of 5 bar and a volume of water of 670 ml/min. The droplets within the spray mist have an average diameter of 57 μm. The diameter of the mist chamber 5 is 200 mm. Below the mist chamber and at a distance of 240 cm as measured from the spinneret is a guide roll 6. The speed at which the yarns are fed is set at 295 m/min by the trio of rolls 7. The continuous yarns are dried by a blower 8 using compressed air at 4 bar. A neat oil is then applied as spin finish in a finish application zone 9. Pre-drawing is then carried out by the trio of rolls 10 and the steam nozzle 11. The continuous yarns are heated by the steam from the nozzle 11 (the temperature of the nozzle being approx. 230° C.) and a draw ratio of 4.2 is obtained. Further drawing at a ratio of 1.5 then occurs by means of the dectet of rolls 12, so that a total draw ratio of 6.3 results. The final speed after drawing is 1890 m/min. The continuous yarns then pass the septet of rolls 14, through which they are again guided at 1890 m/min. A relaxation then takes place by means of the trio of rolls 14, the speed of which is 1790 m/min, with relaxation taking place at a draw ratio of 0.95. Finally, the continuous yarns are wound up at a speed of 1790 n/min.

The data for the continuous yarns so obtained are determined as in ASTM D885. For hot-air shrinkage measurements, the yarns are exposed for 2 minutes to a temperature of 180° C. The following data are measured:

| | |
|---|---|
| Total titre: | 1118 dtex f 211 |
| Strength: | 924 mN/tex |
| Elongation: | 13.5% |
| Initial modulus: | 11.9 N/tex at 0.25% elongation |
| Hot-air shrinkage: | 7% |

The data show that high-strength yarns with very good properties can be obtained by the method of the invention.

The invention claimed is:

1. A method for simultaneous spin-drawing of continuous yarns comprising one or more filaments, comprising:

feeding a melt of a thermoplastic material to a spinning device, extruding the melt through a spinneret, hot tube and air-permeable porous tube by means of extrusion openings to form continuous yarns, cooling the continuous yarns by feeding them through a first and second cooling zone, wherein the continuous yarns are cooled essentially by a stream of air on passing through the first cooling zone and essentially by a fluid comprising a component that is liquid at room temperature, on passing through the second cooling zone, drying the cooled continuous yarns, and subsequent to drying the cooled continuous yarns, drawing and winding up the continuous yarns by means of winding devices, wherein the continuous yarns are fed through the first and second cooling zones at a speed of up to 500 m/min, and the residence time of the continuous yarns within the first cooling zone is at least 0.1 sec.

2. Method according to claim 1, wherein the residence time of the continuous yarns within the first cooling zone is a maximum of 0.3 sec.

3. Method according to claim 1, wherein the residence time of the continuous yarns within the first cooling zone is between 0.1 and 0.25 sec.

4. Method according to claim 1, wherein the thermoplastic material consists essentially of polyester or polyamide.

5. Method according to claim 1, wherein the continuous yarns are essentially fed through an air-permeable, porous tube as the first cooling zone.

6. Method according to claim 1, wherein the continuous yarns are essentially cooled by a water-bath on being fed through the second cooling zone.

7. Method according to claim 1, wherein the continuous yarns are essentially cooled by a spray mist of small water droplets on being fed through the second cooling zone.

8. Method according to claim 1, wherein the continuous yarns are additionally treated with a spin finish after drying.

9. Method according to claim 1, wherein the continuous yarns are additionally subjected to pre-drawing.

10. Method according to claim 9, wherein pre-drawing is performed using a steam-emitting nozzle.

11. Method according to claim 9, wherein pre-drawing is performed after the yarns have left the second cooling zone and prior to drying.

12. Method according to claim 11, wherein pre-drawing takes place in a water-bath.

13. Method according to claim 1, wherein the continuous yarns are additionally relaxed after drawing and before being wound up.

14. Method according to claim 1, wherein the continuous yarns are wound up at speeds below 3000 m/min.

15. Method according to claim 1, wherein more than six continuous yarns are simultaneously produced.

16. Method according to claim 1, wherein the continuous yarns consist of one or more filaments.

17. Method according to claim 1, wherein said fluid consists essentially of said component that is liquid at room temperature.

18. Method according to claim 1, wherein said fluid consists of said component that is liquid at room temperature.

* * * * *

UNITED STATES PATENT AND TRADEMARK OFFICE

CERTIFICATE OF CORRECTION

PATENT NO. : 7,070,723 B2
APPLICATION NO. : 10/250505
DATED : July 4, 2006
INVENTOR(S) : Gerrit Ruitenberg and Bastiaan Krins It is certified that error appears in the above-identified patent and that said Letters Patent is hereby corrected as shown below:

Column 2,
Between Lines 27 and 28, insert paragraph --The Figure is schematic view of a device suitable for carrying out the method of the present invention.--.

Column 6,
Line 54, change “n/min.” to --m/min.--.

Column 7,
Line 19 Claim 1, replace “subsequent to drying the cooled continuous yarns, drawing and winding up the continuous yarns by means of winding devices,” to --subsequently drawing and winding up the continuous yarns by means of winding devices,--

Signed and Sealed this

Sixth Day of November, 2007

JON W. DUDAS
*Director of the United States Patent and Trademark Office*